US005613892A

United States Patent [19]

Barton

[11] Patent Number: 5,613,892

[45] Date of Patent: Mar. 25, 1997

[54] INFLATABLE PLUSH TOY

[76] Inventor: Leslie W. Barton, 2818 Westridge, Carollton, Tex. 75006

[21] Appl. No.: 414,276

[22] Filed: Mar. 31, 1995

[51] Int. Cl.[6] ..... A63H 3/06

[52] U.S. Cl. ..... 446/226; 446/224

[58] Field of Search ..... 446/224, 226, 446/223, 221, 220, 369

[56] References Cited

U.S. PATENT DOCUMENTS

| | | | |
|---|---|---|---|
| 4,077,588 | 3/1978 | Hurst | 446/226 |
| 4,674,532 | 6/1987 | Koyanagi | 446/224 X |
| 5,335,436 | 8/1994 | Gurr | 446/226 X |

FOREIGN PATENT DOCUMENTS

| | | | |
|---|---|---|---|
| 912716 | 12/1962 | England | 446/226 |
| 941546 | 11/1963 | England | 446/226 |
| 1375573 | 9/1964 | France | 446/226 |
| 38360 | 11/1971 | Japan | 446/226 |
| 2214830 | 9/1989 | United Kingdom | 446/226 |
| 9001976 | 3/1990 | WIPO | 446/226 |

*Primary Examiner*—Robert A. Hafer
*Assistant Examiner*—D. Neal Muir
*Attorney, Agent, or Firm*—Harris, Tucker & Hardin, P.C.

[57] ABSTRACT

Inflatable plush toys are disclosed. The inflatable plush toys are made up of an outer cover and an inflatable inner bladder that is made of a substantially nonelastic film or sheet material. The inflatable bladder has substantially the same size and configuration of the outer cover whereby upon inflation the inner bladder fills substantially the entire interior of the outer cover. The outer cover and inflatable bladder can be made of a plurality of gores that are cut to desired size and then sealed together. The plush toys can have rather intricate shapes such as animal shapes, cartoon figure shapes and the like. A valve is disposed within the inflatable bladder whereby the bladder can be inflated with a suitable inflation gas such as air. In a preferred mode, the valve can be utilized to deflate the bladder whereby the object can be subjected to multiple inflation and deflation cycles.

2 Claims, 2 Drawing Sheets

INFLATABLE PLUSH TOY

FIELD OF THE INVENTION

The invention pertains to inflatable plush toys having intricate animal and animated character shapes and features and which are suitable for multiple inflation and deflation cycles.

BACKGROUND OF THE INVENTION

The success of amusement parks, fairs, carnivals, parades, parties, and other gala events oftentimes depends upon, among other things, the prizes offered as door giveaways, gifts, game winnings and sales items. Many times these prizes include plush toys in the shape of animals and other animated characters. Further, plush toys are marketed by wholesale and retail establishments to children, toy collectors and other purchasers. The most appealing plush toys are those having intricate shapes and detailed features. Fully shaped bodies of animals and animated characters captivate and charm those who enjoy plush toys. Detailed paws, fingers, toes, ears, and noses, are also fascinating. Equally important, though, to manufacturers, wholesalers, retailers and gala event coordinators, are shipping and storage considerations.

Conventional plush toys include those which have an outer covering stuffed with material such as styrofoam beads, cotton batting or the like. These conventional plush toys have several disadvantages. First, the stuffing material substantially increases the overall weight and bulk of the plush toy. A heavier and bulkier toy is unwieldy and thus more difficult to ship and store. Also, the associated costs are greatly increased. Further, weighty and unwieldy plush toys are more difficult to handle and play with by children and others. Second, the conventional stuffing material renders the plush toy incapable of reduction to a compact size. The stuffing cannot easily be removed from the plush toy to reduce the volume and bulk of the plush toy. Further, even if the stuffing material were removed thereby minimizing the size and weight of the plush toy, the stuffing itself would have to be shipped and stored. Thus, the purpose for removing the stuffing is defeated. Third, when the plush toy is no longer useful, conventional stuffing material requires disposal in a landfill or the like, thus raising environmental concerns.

Another conventional plush toy is one whose outer covering is shaped by an inner envelope filled with air. The inner envelope is typically fabricated from latex or other elastomeric material. A plush toy of this type also has several disadvantages. First, the elastomeric material renders the shape of the inner envelope substantially spherical or elliptical. The shape of the outer covering is also substantially spherical or elliptical because it conforms to the inflated inner envelope. Thus, fully shaped animals and other animated characters which the toy attempts to depict are only crudely portrayed. Second, the elastomeric properties of the inner envelope dissipate over time and the material is subject to rupture if inflated too greatly. The useful life of the plush toy is thus lessened by these limitations of the elastomeric inner envelope. Third, elastomeric materials are somewhat permeable to air. The air contained in the inner envelope escapes over time, resulting in an unwanted deflation of the plush toy. Fourth, elastomeric materials require a great amount of air pressure to inflate. Thus, a durable source of air pressure is required to inflate the plush toy.

An inflatable toy which includes an outer fabric casing and an inner inflated rubber balloon to provide shape to the casing is described in U.S. Pat. No. 2,685,758 (the '758 patent). The '758 patent discloses an inflatable toy having an inelastic casing that can be cleaned or replaced with other casings of different caricatures. A balloon is inserted through a small opening in the casing and then inflated. Stuffing material is used in the portions of the casing not supported by the inflated balloon, namely the arms and legs of the caricatures. Such an inflatable toy has several disadvantages. First, the body of the caricature is necessarily limited to an elliptical or spherical shape which reflects the shape of the inner balloon. A toy having an elliptical or spherical body is less appealing than plush toys fully shaped. Second, the stuffing material in the arms and legs of the caricature add weight and bulk to the toy. While the stuffing may fully shape the arms and legs, the stuffing is somewhat permanent and cannot be removed to facilitate compactness of the toy. Third, the inner balloon material is permeable to air and when inflated, allows the captured air to escape over time. Thus, undesirable deflation of the toy will result.

Another inflatable toy is disclosed in U.S. Pat. No. 2,503,948 (the '948 patent) of Henry. The inflatable toy is more particularly a doll which includes a flexible casing constituting the torso of the doll. The casing is provided with an opening for removably receiving an inflatable bladder to maintain the casing in an expanded or taut condition. The bladder is fashioned of rubber and has sufficient flexibility to substantially fill the cavity within the casing. The bladder conforms substantially in configuration with the casing. Arms, legs, and a head are hollow and connected with the body of the doll. Such a toy has several disadvantages as a plush toy. First, the toy lacks the capability for reduction to a minimal size. While the inner bladder is deflatable which allows the casing to collapse, the arms, legs, and head remain substantially the same in size. Shipping, storage, and handling of these toys are more difficult and costly. Second, as with the '758 patented toy, the bladder is fabricated from rubber and thus has the inherent limitations of an elastomeric material. These limitations include unwanted deflation from rupture, puncture, or escaping air from the somewhat permeable rubber. Also, a great amount of air pressure is required to inflate the rubber bladder.

U.S. Pat. No. 1,216,425 (the '425 patent) also discloses an inflatable toy. The toy includes a casing of fabric or other inelastic material having an oval or other elongated form. A substantially spherical inflatable balloon constructed of elastic rubber is arranged within the casing. When inflated, the balloon expands the elongated casing and conforms to the shape of the casing. Ears, legs, and a tail may be stitched to the casing and other features marked on the casing to represent an animal. Several disadvantages of this inflatable toy are present. First, the animal body is limited to spherical or elliptical shapes. These shapes are crude and less appealing than fully shaped toys. Also, merely stitching the legs, ears and tails to the spherical body is crude as well. Second, the inner inflatable balloon has the same inherent limitations of elastomeric materials as described above for the '758 and '948 patented toys.

A toy balloon is disclosed in U.S. Pat. No. 4,758,199 (the '199 patent). The toy includes a balloon envelope for use in conjunction with an imitation gondola. The balloon envelope comprises an inflatable gas bag and a decorative imitation envelope which surrounds the gas bag and substantially conforms to the shape of the inflated gas bag. The gas bag can be constructed from a flexible latex which inflates to a spherical shape. The gas bag may also be fabricated from an nonstretchable, air impermeable material which inflates to an unconventional shaped hot air balloon. The imitation envelope is constructed from decorative materials. This hot air balloon toy is disadvantaged as a plush toy. Even though a nonstretchable material may be used for the gas bag, unconventional hot air balloon shapes are typically obtuse. Thus, these shapes are too crude for the detailed and fully shaped bodies of animal and animated characters required for plush toys.

With the foregoing problems associated with prior art plush toys in mind it is apparent that there is a long felt need for improved plush toys. Ideally, a plush toy should be lightweight and compact during shipping for ease of handling. Further, space requirements for storage during shipping and for inventory should be minimal for lightweight and compact plush toys. Costs associated with shipping and storage of the compact toys should be lower than for heavy and bulky toys. Lightweight and compact plush toys are desirable for shipping and storage, are desirable for coordinators of traveling carnivals, periodic fairs, one-time events and the like. Likewise, plush toys which can be easily inflated to full size for viewing by would-be purchasers are highly desirable. Deflating the plush toy to its compact size for transporting to other locations for reinflation is desirable. Suitable plush toys that are capable of multiple inflation and deflation cycles are also highly desirable. Ultimate purchasers, owners, and users of the plush toys will also desire plush toys suitable for multiple inflation and deflation cycles. The instant invention satisfies all of such needs.

SUMMARY OF THE INVENTION

The instant invention is directed to an inflatable plush toy comprising an inflatable inner bladder adapted for inflation and deflation inside an outer cover. The outer cover is normally a cover having a textured surface such a pile or plush surface that resembles fur, skin, scales and the like that are normally observed on animals and cartoon-like figures. The inner bladder is made from a substantially nonelastomeric material that is capable of containing an inflation gas, such as air over a long period of time. The outer cover can be shaped into various shapes to simulate or depict animals, animated characters and other objects. The inner bladder material is made to substantially conform to the desired shape of the outer cover material and completely fill the interior of the cover whereby upon inflation, the desired shape is obtained. The inner bladder as well as the outer cover can be made of multiple gores of sheet material to form the desired shapes. By using a heat sealable sheet material for formation of the inner bladder, the inner bladder is easily manufactured using conventional cutting and heat sealing techniques. Such heat sealing techniques can include the incorporation of conventional filling valves in the inner bladder whereby the inner bladder can be filled with an inflation gas such as air. Such conventional valves can also be utilized to deflate the plush toy to allow for multiple inflation and deflation cycles. Suitable decorative designs can be applied to the outer cover as well as to portions of the inner bladder that may be exposed through cutouts or apertures in the outer cover material.

DETAILED DESCRIPTION OF THE PREFERRED EMBODIMENT

The instant invention is an inflatable plush toy that is made up of an inflatable inner bladder disposed inside an outer covering. The inner bladder and the outer covering are sized such that when the inner bladder is inflated it completely fills the interior of the outer cover. The inner bladder is made of a substantially nonelastomeric sheet material such as conventional polyester films and sheets. The bladder as well as the outer covering can be comprised of a plurality of gores that are cut and sealed together to form the desired shape. The bladder material is selected from well known sheet materials that allow a gas to be contained within the sealed bladder for a long period of time. Materials such as nylon, mylar polyester, vinyl chloride, polyethylene, polypropylene and the like are quite effective for forming the bladder. The gores of the bladder as well as the outer covering can be cut and formed into various desired shapes to simulate animals, cartoon characters and other objects. A conventional fill valve is utilized in the formation of the bladder whereby an inflation gas such as air can be injected into the bladder to inflate it. If desired, the valve can have the capability of deflating the bladder whereby the formed object can be subjected to multiple inflation and deflation cycles. By using such a valve, the objects of this invention can be deflated into a compact substantially flat form for shipping and storing. Of course the deflated objects can then be reinflated as desired to form a lightweight inflated object having the desired form and appearance.

Figure 1:
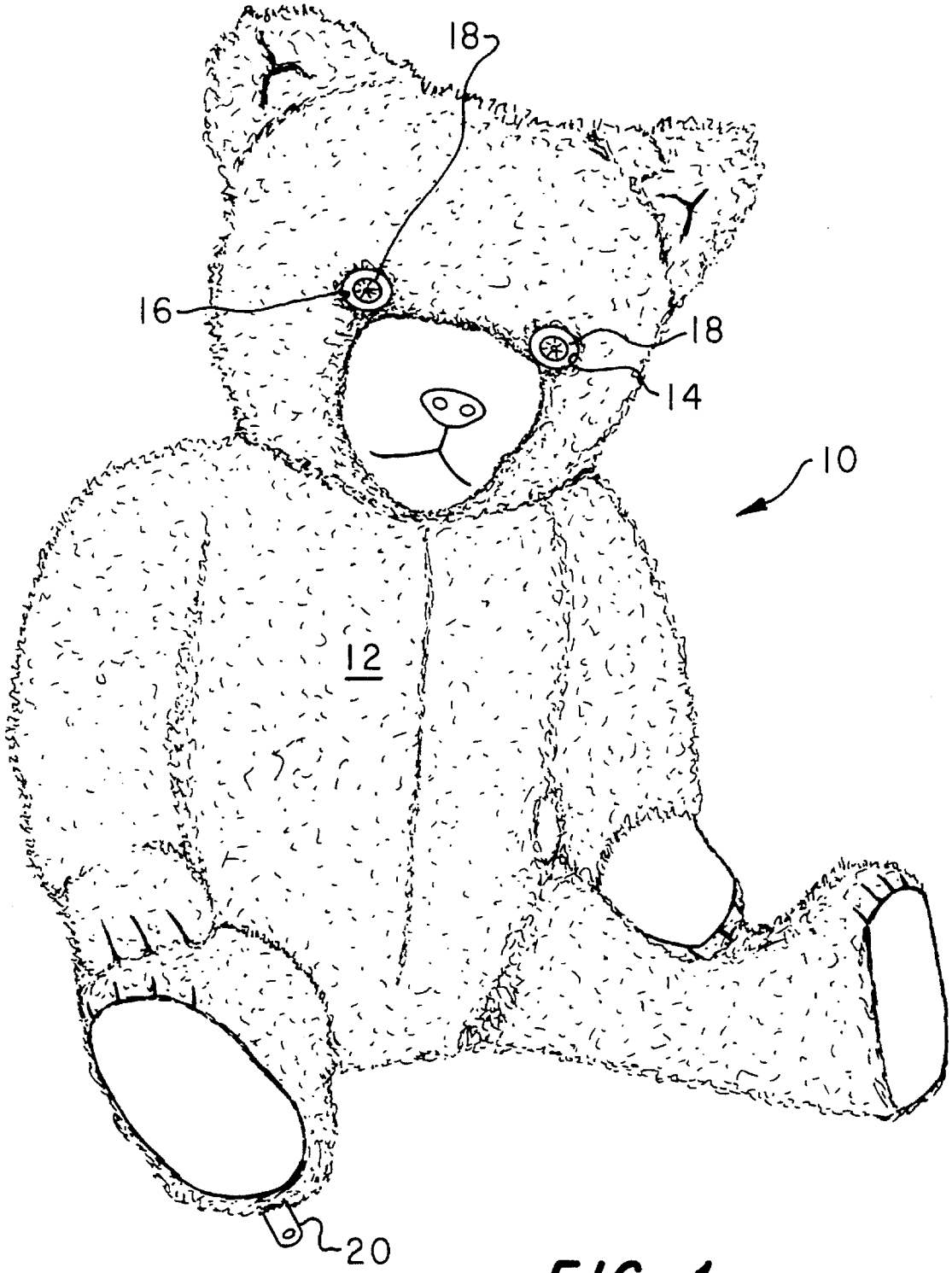
FIG. 1 is a perspective view of an inflatable plush toy made in accordance with the instant invention.

The objects of this invention can best be described by referring to the drawings which illustrate some of the preferred embodiments of the invention. A toy bear-like inflatable toy is illustrated in FIG. 1 by the designation 10. For illustrative purposes, bear toy 10 is shown in an inflated state. It will be apparent that the bear toy has simulated arms, legs, body and head. The outer cover 12 can be formed of any suitable sheet like material such as sheet plastic, fabric and the like. If desired, the surface of outer cover 12 can have a pile or plush like texture to simulate fur or skin or other surface of the object depicted. The inflatable bladder has a shape and size substantially the same as the outer cover.

In bear toy 10, a portion of outer cover 12 is cut away in eye areas 14 and 16 whereby a portion of inflatable bladder 18 is exposed through the apertures. In a preferred embodiment, that portion of the exposed bladder 18 can have suitable designs or decorative features applied to the surface of bladder 18. In the illustration of FIG. 1, eye designs are shown on the exposed portion of bladder 18 which are exposed through apertures 14 and 16 in the outer cover. Such designs can be printed on the surface of bladder 18 or decals can be applied to the bladder surface.

It will be apparent that the outer cover 12 and inflatable bladder 18 can be formed in a myriad of desired shapes to form detailed features for paws, toes, legs, arms and other body parts of various animal like toys made in accordance with this invention. The inner bladder 18 can be formed by cutting the gores to the desired shape and thereafter heat sealing the sheet material together to form the inflatable bladder. It will of course be appreciated that heat sealing is only one method for forming the inner bladder and that other formation techniques such as the use of adhesives and the like can be utilized to form the inner bladder.

Figure 2:
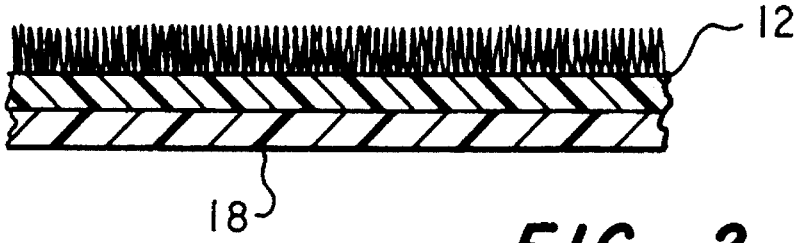
FIG. 2 is a sectional view of the inner bladder wall having a plush outer covering adhered thereto.
Figure 3:
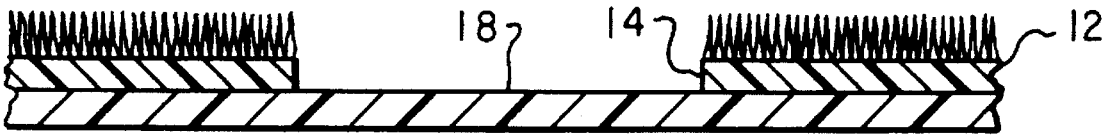
FIG. 3 is a sectional view of a portion of the inner bladder wall with an outer cover having apertures therein to expose a portion of the inner bladder.

It should also be appreciated that in some instances it may be desirable to adhere the outer cover 12 to the surface of the inner bladder 18. As shown in the sectional view of FIG. 2, outer cover 12 is physically adhered to inner bladder 18 by means of lamination techniques well known in the art.

Figure 4:
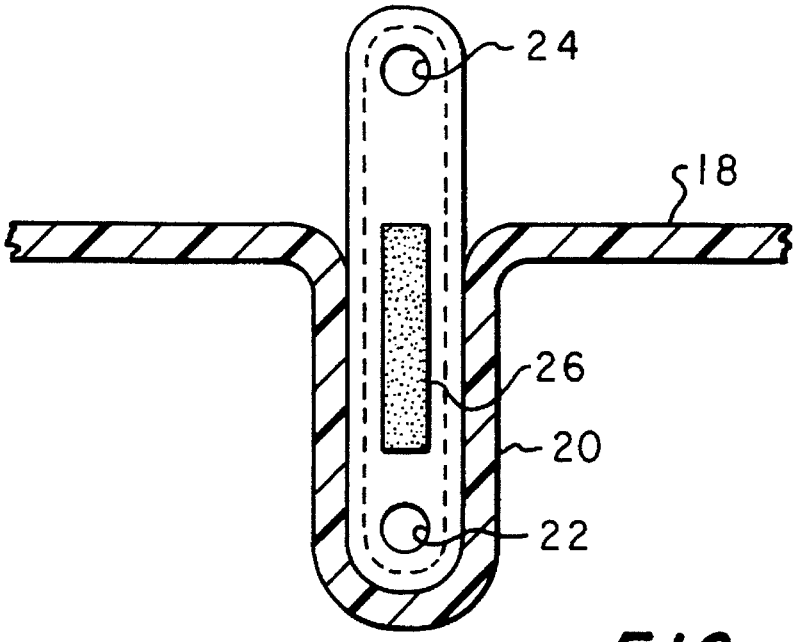
FIG. 4 is a cross sectional view of a portion of the inner bladder wall having a self sealing inflation and deflation valve heat sealed thereto.

Fill valve 20 is illustrated in FIG. 1 by means of the protruding outer end of the valve which is formed as an integral part of inner bladder 18. Fill valve 20 extends through the outer cover 12 whereby an inflation gas can be injected into the bladder 18 to inflate it. Conventional self sealing valves are well known in the art and can be utilized in conjunction with the instant invention. For example, self sealing reusable inflation valves described in U.S. Pat. No. 5,188,558 are especially useful in forming the objects of this invention. As shown in FIG. 4, valve 20 is heat sealed into the periphery of bladder 18 utilizing the techniques more fully described in U.S. Pat. No. 5,188,558. As more fully described in such patent, fill valve 20 has an injection port 22 that is in fluid communication with outlet port 24 which is disposed inside inflatable bladder 18. A heat seal resistant ink area 26 is contained within the valve structure to allow it to be heat sealed into the periphery of bladder 18 without sealing the gas passage shut. When it is desired to inflate bladder 18, an inflation tube can be inserted through port 22 and a compressed gas, such as air, helium or other inflation gas can be injected into the bladder. When the inflation tube is withdrawn from port 22, the valve will self seal to contain the inflation gas within the bladder 18. If desired, a deflation tube can be inserted through port 22 and passed upwardly to outlet port 24 thereby allowing the inflation gas contained within bladder 18 to be withdrawn to thereby deflate the object. It will be apparent that such a structure can be subjected to multiple inflation and deflation cycles.

It should be understood that the drawings and foregoing description merely illustrate some of the preferred embodiments of the invention. Various modifications and changes can be made without departing from the spirit and scope of this invention.

What is claimed is:

1. An inflatable plush toy, comprising:

an inflatable inner bladder made of a substantially non-elastomeric sheet material and having a surface;

an outer covering for containing said inner bladder, said outer covering laminated to said surface of said inner bladder; and a valve structure contained within said bladder for filling and inflating the bladder with an inflation gas;

a portion of said outer covering being cut away to expose a portion of said surface of said inner bladder across said cut away;

wherein said exposed portion of said surface of said inner bladder is intended for application of designs or decals thereto.

2. The inflatable structure of claim 1 wherein said valve is a reusable and self sealing valve.

* * * * *